US006929512B2

(12) United States Patent
Lai

(10) Patent No.: US 6,929,512 B2
(45) Date of Patent: Aug. 16, 2005

(54) CABLE END CONNECTOR ASSEMBLY WITH A SHIELD DEVICE

(75) Inventor: Chin Te Lai, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/879,422

(22) Filed: Jun. 28, 2004

(65) Prior Publication Data

US 2004/0266266 A1 Dec. 30, 2004

(30) Foreign Application Priority Data

Jun. 27, 2003 (TW) ..... 92211784 U

(51) Int. Cl.[7] ..... H01R 9/03
(52) U.S. Cl. ..... 439/610
(58) Field of Search ..... 439/610, 607, 439/609

(56) References Cited

U.S. PATENT DOCUMENTS 5,338,227 A * 8/1994 Nakamura ..... 439/607
5,895,291 A * 4/1999 Furio et al. ..... 439/610
5,961,351 A * 10/1999 Wu ..... 439/610
6,036,543 A * 3/2000 Panis et al. ..... 439/607
6,113,429 A * 9/2000 Weigel et al. ..... 439/610
6,203,377 B1 * 3/2001 Grek et al. ..... 439/610
6,231,392 B1 * 5/2001 van Woensel ..... 439/610
6,238,246 B1 * 5/2001 Ferrill et al. ..... 439/610
6,280,252 B1 * 8/2001 Huang ..... 439/610
6,299,487 B1 10/2001 Lopata et al.
6,705,897 B2 * 3/2004 Chen et al. ..... 439/610
6,821,151 B2 * 11/2004 Lai ..... 439/610
6,857,904 B2 * 2/2005 Lai ..... 439/610

* cited by examiner

*Primary Examiner*—Ross Gushi
(74) *Attorney, Agent, or Firm*—Wei Te Chung

(57) ABSTRACT

A cable end connector assembly (1) includes a cable end connector (2) and a cable (3). The cable end connector has an insulative housing (21), a plurality of contacts (220) received in the housing, and a shield device (23). The cable (3) comprises a plurality of wires (31) respectively connecting to the contacts of the cable end connector and a shielding braid (32) enclosing the wires. The shield device comprises a first shield portion (231) inserted into the housing, a second shielding portion (232) assembled to a rear end of the first shield portion, and a third shielding portion (233) assembled to a rear end of the second shielding portion, a rear portion (2332) of the third shield portion clamping a part of the cable. The shielding braid is positioned between the second, and third shielding portions.

16 Claims, 7 Drawing Sheets

CABLE END CONNECTOR ASSEMBLY WITH A SHIELD DEVICE

BACKGROUND OF THE INVENTION

1. Field of the Invention

The present invention relates to a cable end connector assembly, and more particularly to a cable end connector assembly having shielding means to prevent electromagnetic or radio frequency interference.

2. Description of Prior Art

Electrical connector assemblies are commonly used to connect external and internal peripheral devices to a computer for performing data transmission therebetween. The connector assembly typically employs a cable end connector assembly terminated with a transmission cable and a receptacle connector mounted on a printed circuit board of the computer and electrically connected with the cable end connector assembly. U.S. Pat. No. 6,299,487 discloses such a connector assembly with a cable end connector assembly and a receptacle connector. The cable end connector assembly includes a housing, a contact module disposed in the housing with a plurality of contacts retained therein, a first shell partially insert-molded in the housing for eliminating electromagnetic interference of the contacts, and a cable with a distal end thereof electrically connecting to the contacts. The receptacle connector comprises an internal and external shells being soldered to each other, the external shell encloses the internal shell to reduce electromagnetic or radio frequency interference.

In the patent mentioned above, the cost of the soldering process of the internal and external shells of the receptacle connector will be increased. However, when the internal and external shells are needed to depart, the internal and external shells will be damaged. So, it is not convenient to rework.

Hence, a cable end connector assembly with simple and improved shielding means is required to overcome the disadvantages of the prior art.

SUMMARY OF THE INVENTION

An object of the present invention is to provide a cable end connector assembly having a simple and improved shielding means with a number shells assembled together to eliminate electromagnetic interference.

Another object of the present invention is to provide a cable end connector assembly with a number removable shells for decreasing manufacture cost and enhancing convenience of reworking.

In order to achieve the objects set forth, a cable end connector assembly includes a cable end connector and a cable.

The cable end connector has an insulative housing, a plurality of contacts received in the housing, and a shield device. The cable comprises a plurality of wires respectively connecting to the contacts of the cable end connector and a shielding braid enclosing the wires. The shield device comprises a first shield portion inserted into the housing, a second shielding portion assembled to a rear end of the first shield portion, and a third shielding portion assembled to a rear end of the second shielding portion. A rear portion of the third shield portion clamps a part of the cable, the shielding braid is positioned between the second, and third shielding portions.

Other objects, advantages and novel features of the invention will become more apparent from the following detailed description when taken in conjunction with the accompanying drawings.

DETAILED DESCRIPTION OF THE INVENTION

Figure 1:
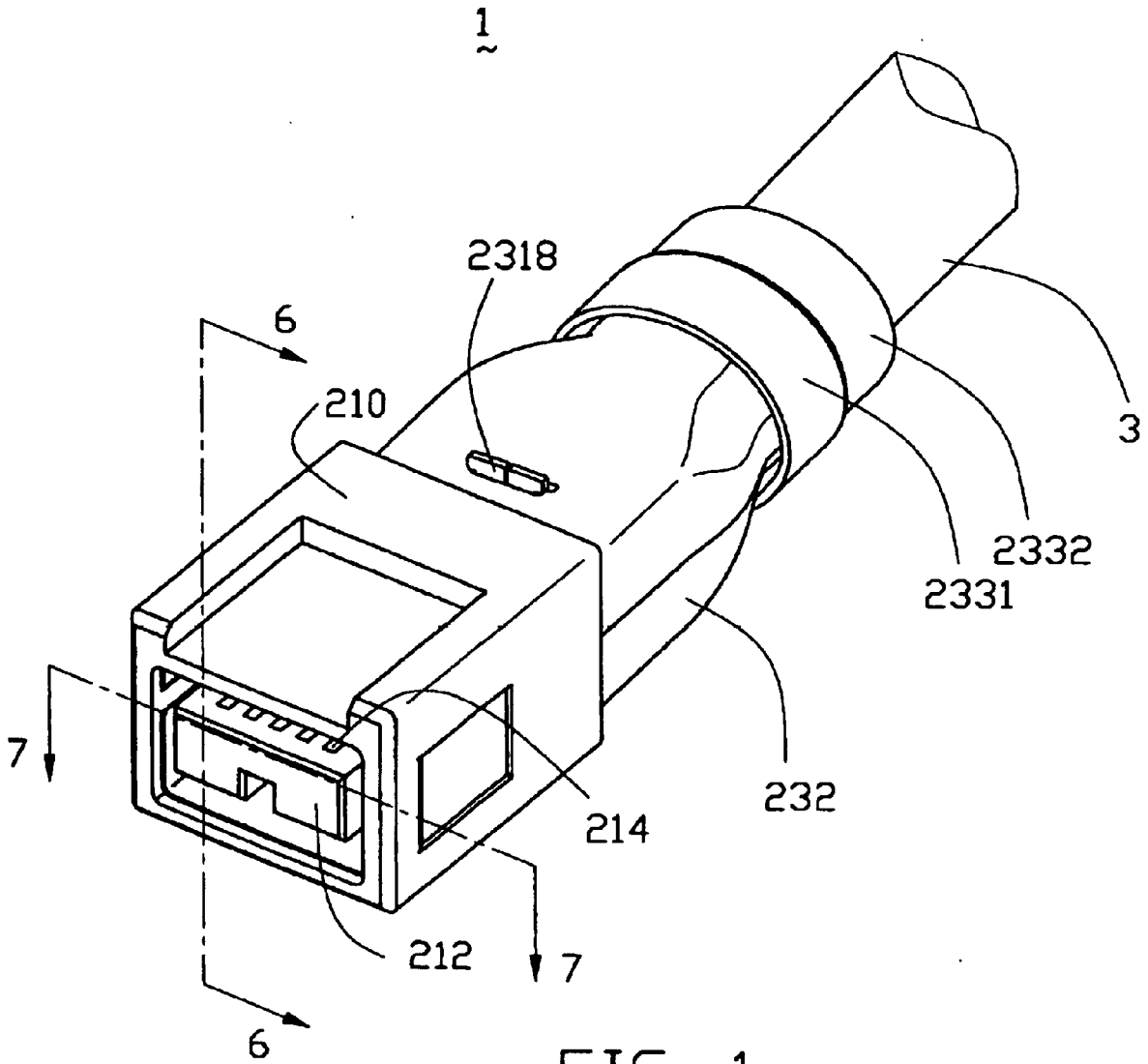
FIG. 1 is an assembled, perspective view of a cable end connector assembly in accordance with the present invention.
Figure 2:
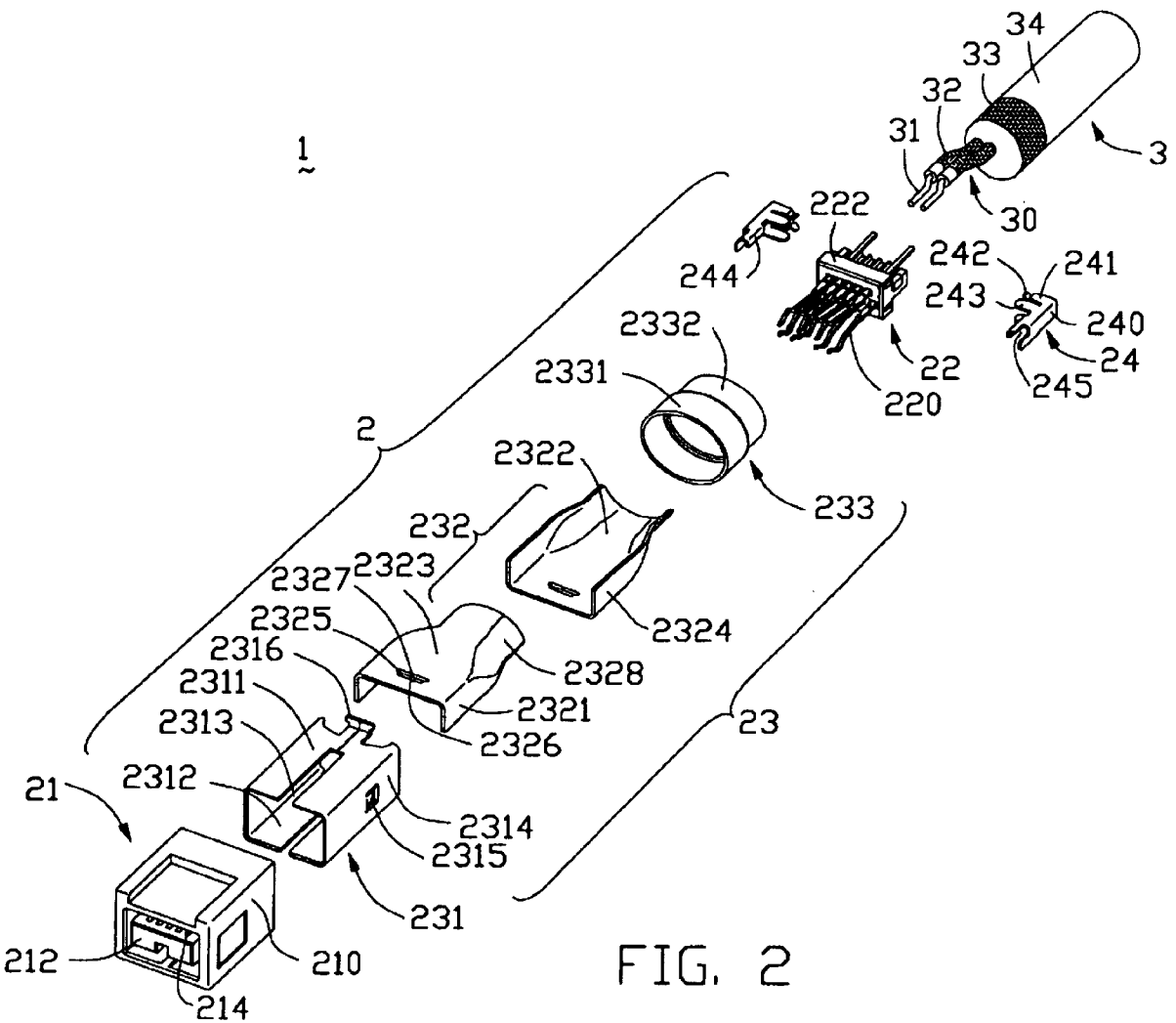
FIG. 2 is an exploded, perspective view of the cable end connector assembly of FIG 1.
Figure 3:
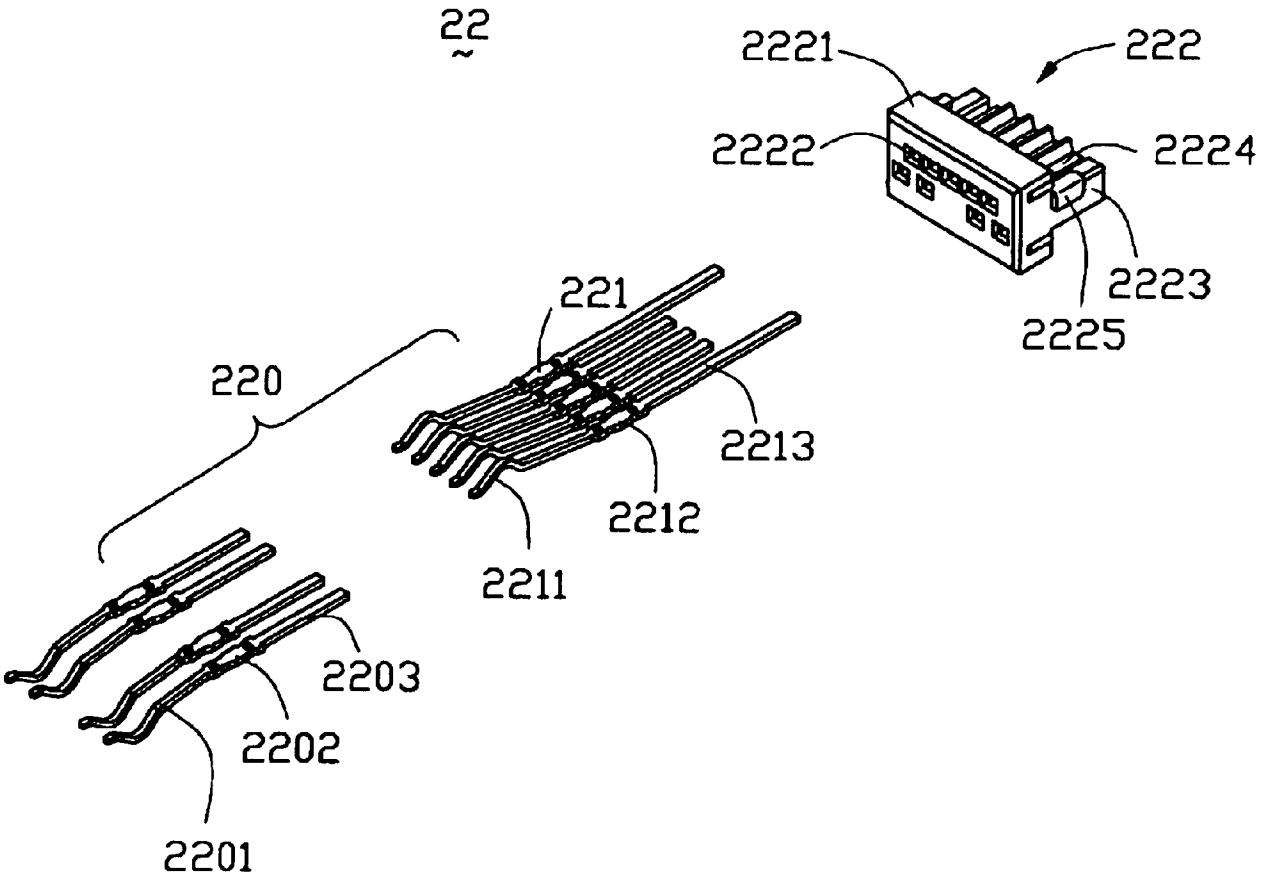
FIG. 3 is an exploded, perspective view of a contact module of FIG. 1.

Referring to FIGS. 1 to 2, a cable end connector assembly 1 in accordance with the present invention is adapted to a transmitting standard of IEEE 1394b, the cable end connector assembly 1 includes a cable end connector 2 and a cable 3. Referring to FIG. 3, the cable end connector 2 comprises an insulative housing 21, a contact module 22, a shield device 23 and a pair of grasp members 24.

Figure 6:
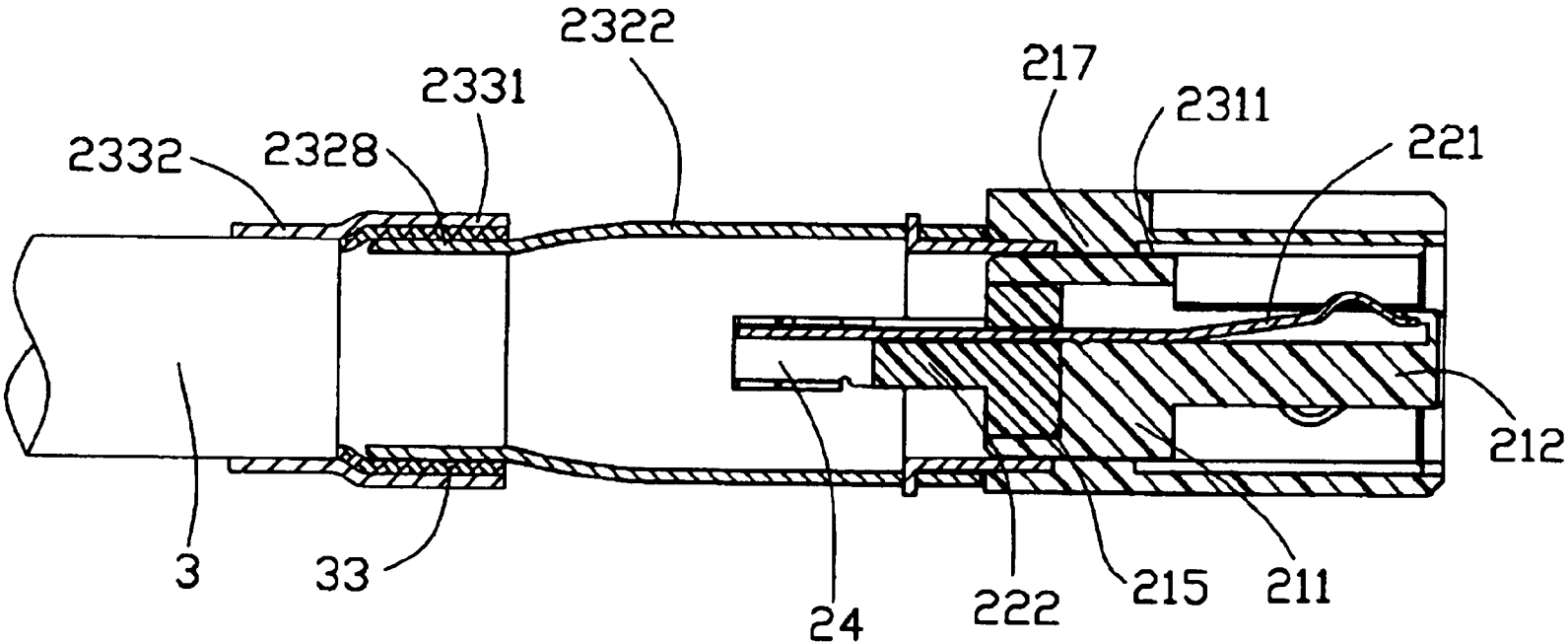
FIG. 6 is a cross-sectional view taken along line VI—VI of FIG. 1.
Figure 7:
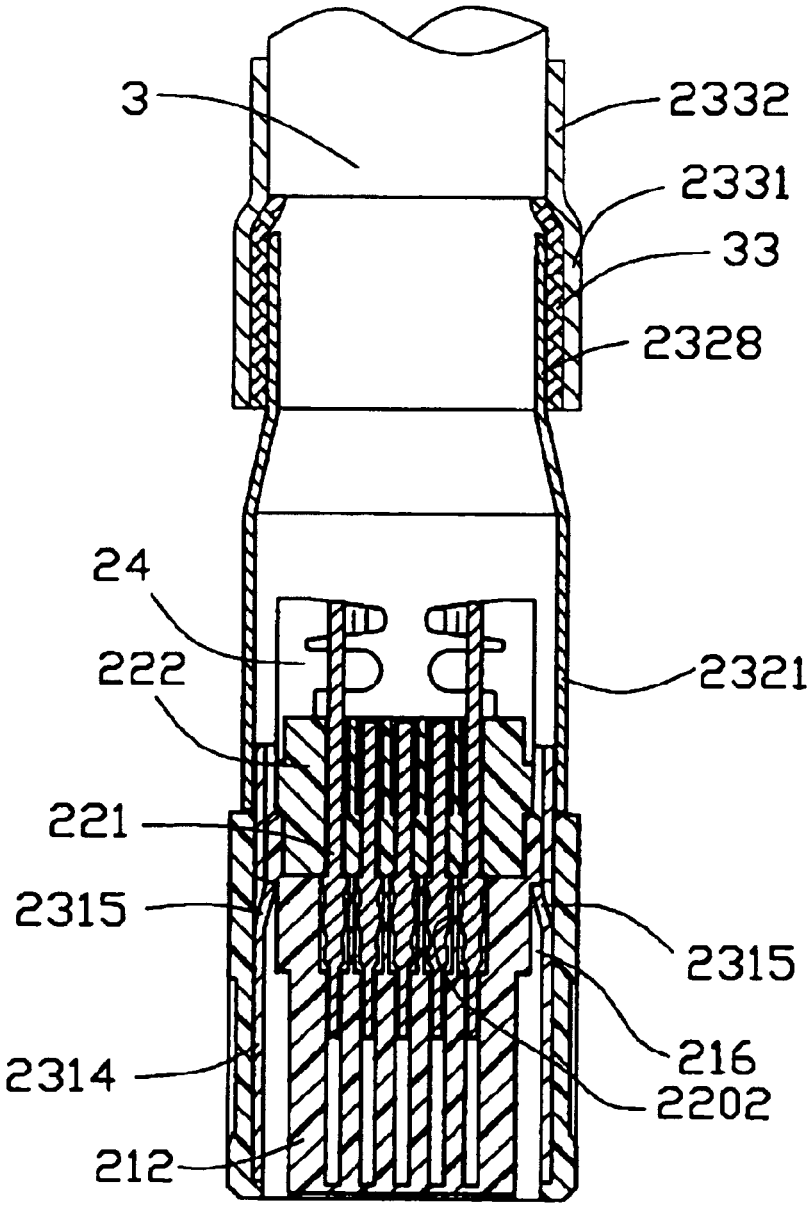
FIG. 7 is a cross-sectional view taken along line VII—VII of FIG. 1.

Referring to FIGS. 2, 6 and 7, the insulative housing 21 includes a rectangular frame 210 and a rectangular base 211 formed integrally with the frame 210. A tongue plate 212 extends forwardly from a center of a front end of the rectangular base 211. The tongue plate 212 defines a plurality of passageways 214 on a top and bottom surface (not labeled) thereof. A receiving space 215 is defined and extends forwardly from a rear end of the base 211. A projection 217 is formed at a center of a top and bottom wall (not labeled) of the base 211 respectively and extends along a length of the tongue plate 212 for connecting the base 211 and the frame 210 integrally. The base 211 defines two recesses 216 in opposite side surface(not labeled) thereof.

Also Referring to FIG. 3, the contact module 22 includes a dielectric holder 222, and a plurality of contacts 220 assembled to the dielectric holder 222. The contacts 22 include signal contacts (not labeled), grounding contacts 221, power contacts (not labeled), and so on. The arrangement of these different types of contacts complies with the specification of IEEE 1394b, and here will not describe any more. All of the contacts 220 have the same configuration, and each contact 220 includes a contacting portion 2201, 2211, a retaining portion 2202, 2212 extending rearward from a rear end of the contacting portion 2201, 2211, and a tail portion 2203, 2213 extending rearwardly from a rear end of the retaining portion 2202, 2212.

The dielectric holder 222 is generally T-shaped and includes a main portion 2221 and a retention portion 2223 extending rearward from a rear surface of the main portion 2221. The main portion 2221 defines a plurality of slots 2222 extending along a front-to-rear direction. The retention portion 2223 defines a plurality of apertures 2224 on a top, bottom surface thereof communicating with the slots 2222. A connecting area between each side and top surface of the retention portion 2223 forms a protrusion 2225. Referring to FIGS. 6, 7, the retention portions 2202, 2212 of contacts 220 are retained in the slots 2222. The tail portions 2203, 2213 extend through the slots 2222 and are received in the apertures 2224 of the dielectric holder 222. The dielectric holder 222 is received in the receiving space 215 of the base 211 of the insulative housing 21. The contacting portions 2201, 2211 of the contacts 220 extend through the receiving space 215 and are received in corresponding passageways 214 of the tongue plate 212.

Figure 4:
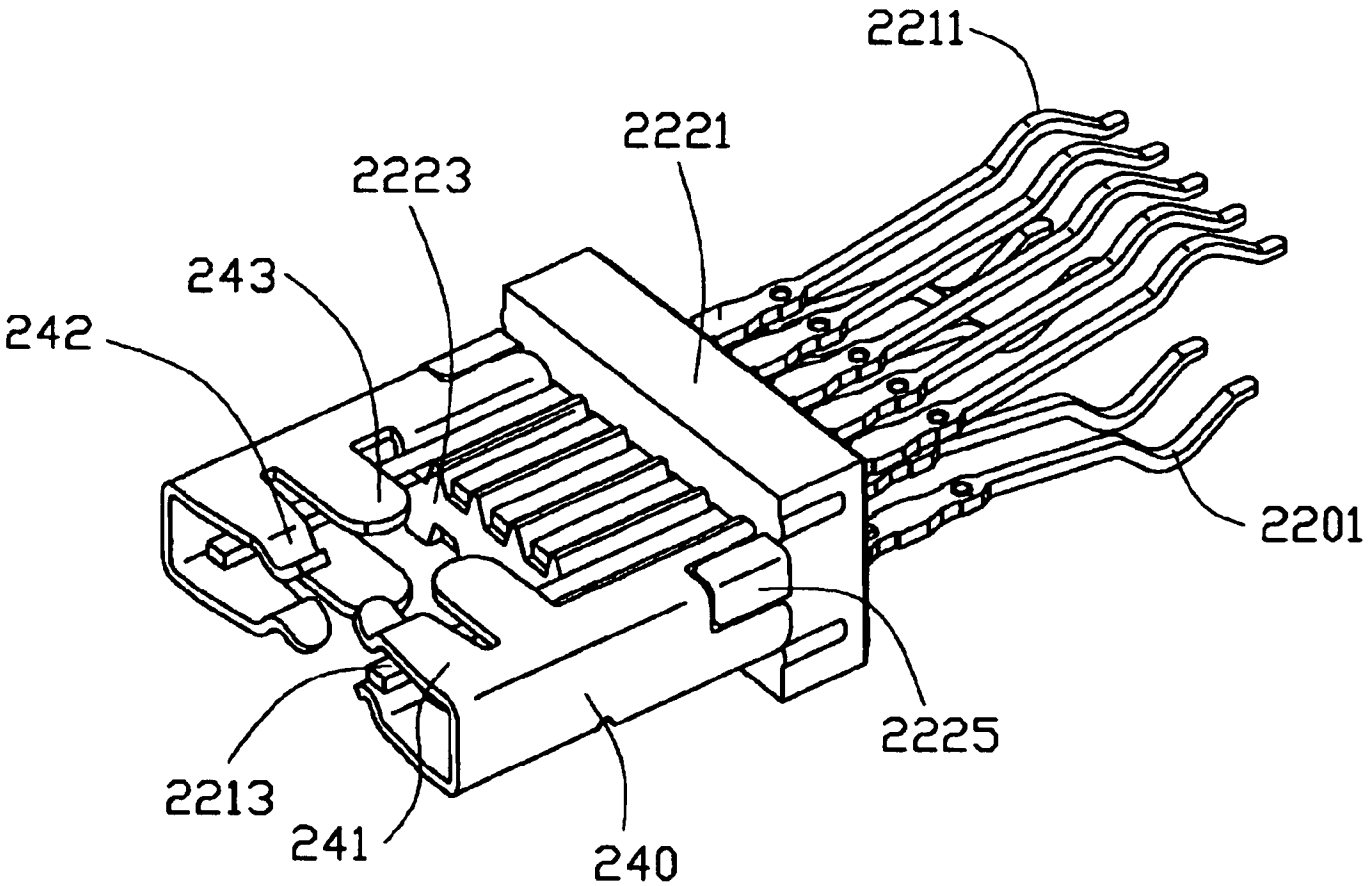
FIG. 4 is an assembled, perspective view of the contact module and a pair of grasp members of FIG. 2
Figure 5:
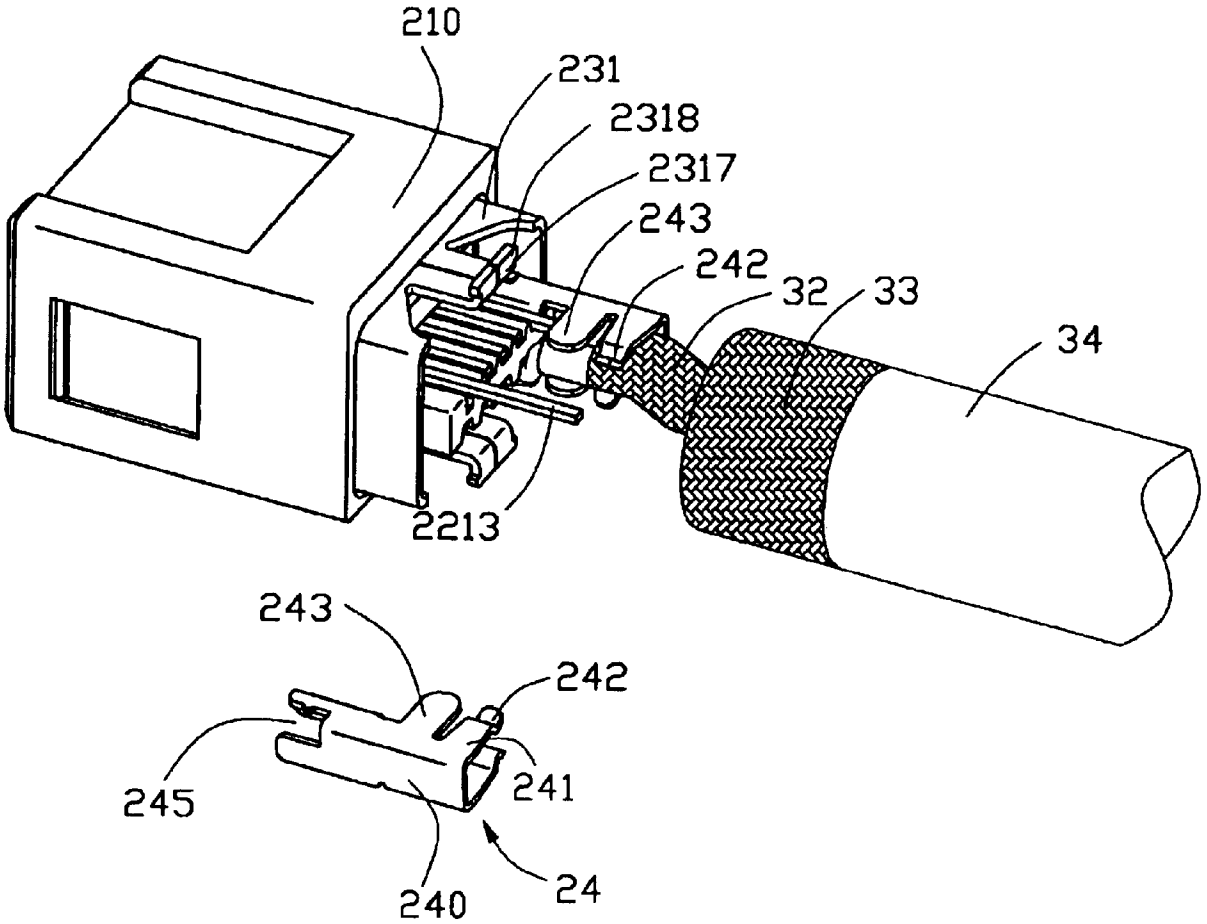
FIG. 5 is an assembled perspective view of a housing, the contact module, a part of a shield device, and the grasp member of FIG. 2.

Referring to FIGS. 2, 4, and 5, each grasp member 24 is stamped and bent from a metal sheet. A top or bottom view of the grasp member 24 is F-shaped. The grasp member 24 has a plated-shaped body portion 240. A pair of spring arms 241 extend vertically and forwardly from opposite upper and bottom sides of each body portion 240. A bending portion 242 is bent and extends outwardly from a rear end of each spring arm 241. A smooth plate 243 adjacent to the spring arm 241 extends along the same direction of the spring arm 241. A leg portion 244 extends forwardly and is bent downwardly from the body portion 240. An opening 245 is defined between the body portion 240 and the leg portion 244.

Referring to FIG. 2, the shield device 23 includes a first shield portion 231, a second shield portion 232, and a third shield portion 233. The first shield portion 231 has an upper, lower, and opposite side walls 2311, 2312, 2314. The opposite sides walls 2314 connecting with the upper and lower walls 2311, 2312. The opposite upper and lower walls 2311, 2312 each defines a slit 2313 extending rearwardly from the front end to the middle portion thereof. Each side wall 2314 defines an elastic tab 2315 extending inwardly and rearwardly thereof. A pair of locking members 2316 are formed at a rear end of the upper and lower walls 2311, 2312 respectively. Each locking member includes a connecting portion 2317 and a stopping portion 2318 connecting the connecting portion 2317.

The second shield portion 232 includes a pair of half covers 2321, 2322. The covers are removable. A front end of each cover 2321, 2322 has a main portion 2323 and opposite side portions 2324 connecting with the main portions 2323. A funnel-shaped portion 2328 extends rearwardly from a rear end of the main portion 2323 of each cover 2321, 2322. The front end of the main portion 2323 of each cover 2321, 2322 defines a channel 2325 being formed by two rectangular cavities 2326, 2327. The rectangular cavity 2327 is longer than another one 2326. A width of the stopping portion 2318 along an extending direction of the channel 2325 is wider than the connecting portion 2317. Therefore, the locking member 2316 is T-shaped. The width of each pair of the stopping portions 2318 is larger than the short cavity 2326 and smaller than the long cavity 2327.

The third shield portion 233 is a hollow tube and made from a metal sheet. The third shield portion 233 comprises a first portion 2331 and a second portion 2332 connecting the first portion 2331. A diameter of the first portion 2331 is larger than the second portion.

The cable 3 includes a plurality of wires 30 (only two being shown in FIG. 2), a first metal shielding braid 33 enclosing the wires 30, and an insulative jacket 34 enclosing the shielding braid 33. The wires 30 include signal wires 31, grounding wires (not shown), and power wires (not shown) corresponding to the signal contacts, grounding contacts 221, and power contacts respectively. A second metal shielding 32 encloses each signal wire 31. A front portion (not labeled) of each signal wire 31 extends beyond the second metal shielding 32. As an example, arrangement of the different types of the wires complies with the specification of IEEE 1394b, which is known and thus will not be further described here.

Referring to FIG. 1-3 and 6-7. In assembly, firstly, the contacts 220 are inserted into the dielectric holder 222 to form the contact module 22 with the retaining portion 2202, 2212 retained in the corresponding slot 2222 of the dielectric holder 222. The tail portion 2203, 2213 extends through the same slot 2222 of the dielectric holder 222 and is received in the aperture 2224 of the retention portion 2223. The grasp members 24 are assembled to lateral sides of the retention portion 2223. Referring to FIGS. 4 and 5, the opening 245 of each grasp member 24 engages with the protrusion 2225 of the dielectric holder 222. The leg portion 244 of the grasp member 24 is bent downwardly into the aperture 2224 of the retention portion 2223 and contacts the grounding contacts 221 for achieving an electrically connection.

Secondly, the contact module 22 and the grasp members 24 are assembled to the housing 2 along a rear-to-front direction. The contacting portions 2201, 2211 of the contacts 220 are received in the corresponding passageways 214 of the tongue plate 212 of insulative housing 21. The first shield portion 231 of the shield device 23 is then assembled into the insulative housing 21 along a rear-to-front direction. A front end of the first shield portion 231 is inserted into a position near the mating portion (not labeled) of the insulative housing 21 and encloses the contact module 22. Thus, the first shield portion can prevent electromagnetic or radio frequency interference. Referring to FIG. 6, the projections 217 are formed at the top and bottom walls of the base 211 of the insulative housing 21 and received in the slits 2313 of the upper wall 2311 and lower wall 2312 respectively of the first shield portion 231. The elastic tabs 2315 of the first shield portion 231 rest against the recesses 216 of the base 211. Therefore, the first shield portion 231 and the insulative housing 21 are assembled securely.

Thirdly, the cable 3 is assembled to the contact module 22. The spring arms 241 grasp the second metal shieldings 32 of the signal wires 31. The bending portions 242 of the spring arms 241 are against the second metal shieldings 32 for enhancing holding force and electrically connection. The smooth plates 243 of the grasp members 24 enclose a part of the front portions of the signal wires extending beyond the second metal shieldings 32. The grasp members 24 connecting the wires 30 are completed, the contacts 220 received in the apertures 2224 of the retention portion 2223 are soldered to the wires 30.

Fourthly, the second shield portion 232 is assembled to the first shield portion 231. The stopping portions 2318 of the first shield portion 231 extend through the long cavities 2327 of the second shield portions 232. The connecting portions 2317 of the locking members 2316 are received in the long cavities 2327, and then pull the second shield portion 232 backwardly. Therefore, the connecting portions 2317 of the locking members 2316 engage the short cavities 2326, and the stopping portions 2318 are locked with opposite sides of the cavities 2326. The covers 2321, 2322 of the second shield portion 232 together form a rectangular receiving space, the funnel-shaped portion 2328 is a hollow tube and encloses the first metal shielding 33 of the cable 3. The first portion 2331 of the third shield portion 233 encloses the funnel-shaped portion 2328 enclosing the first metal shielding 33, and the second portion 2332 shields a front end of the cable 3.

Thereby, the first, second, and third shield portion 231, 232, 233 together form the shield device 23 for achieving a complete shielding. When the shield device 23 needs to remove from the insulative housing 21, a tool is inserted into the insulative housing 21 and presses the elastic tab 2315 of the first shield portion 231 for disconnecting the connection between the shield device 23 and the insulative housing 21. Departing the locking members 2316 from the channels 2325 of the second shield portion 232 can depart the first, second shield portion 231, 232, and the covers 2321, 2322 also can depart to each other. Finally, an over-molding cover (not labeled) is over-molded with a rear end of the cable end connector 2 and the front end of the cable 3. The over-molding cover can provide a protection for the connection of the cable end connector 2 and cable 3 and is convenient to hold.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly comprising:

a cable end connector comprising an insulative housing, a plurality of contacts received in the housing, and a shield device; and a cable comprising a plurality of wires respectively connecting to said contacts of the cable end connector and a shielding braid enclosing said wires; wherein said shield device comprising a first shield portion inserted into the housing, a second shielding portion assembled to a rear end of the first shield portion, and a third shielding portion assembled to a rear end of the second shielding portion, a rear portion of the third shield clamping a part of the cable, said shielding braid positioned between the second, and third shielding portions.

2. The cable end connector assembly as claimed in claim 1, wherein said first shield portion cable comprises locking members, and the second shield portion defines corresponding channels receiving the locking members for assembling the first and second shield portions securely.

3. The cable end connector assembly as claimed in claim 1, wherein said second shield portion cable comprises locking members, and said first shield portion defines corresponding channels receiving the locking members for assembling the first and second shield portions securely.

4. The cable end connector assembly as claimed in claim 2, wherein said locking member comprises a connecting portion, and a stopping portion extending upwardly from the connecting portion, the width of the stopping portion being wider than connecting portion.

5. The cable end connector assembly as claim in claim 1, wherein said second shield portion comprises a pair of half covers together defining a complete receiving space.

6. The cable end connector assembly as claim in claim 3, wherein each channel is defined by a longer cavity and a shorter cavity.

7. The cable end connector assembly as claimed in claim 6, wherein said connecting portions of the locking members are received in the shorter cavity, and said stopping portions of the locking members extend through the longer cavity and are positioned at both sides of the short cavity.

8. The cable end connector assembly as claimed in claim 1, wherein said first shielding portion comprises top, bottom and opposite side walls together defining a rectangular frame.

9. The cable end connector assembly as claimed in claim 1, wherein said rear portion of the second shield portion is a funnel-shaped portion closed by a front portion of the third shielding portion.

10. The cable end connector assembly as claimed in claim 9, wherein said third shield portion is a hollow tube, and the front portion has a larger diameter than the rear portion.

11. The cable end connector assembly as claimed in claim 1, wherein further comprising a pair of grasp members each grasping the wire.

12. The cable end connector assembly as claimed in claim 11, wherein the contacts include power, signal, and grounding contacts.

13. The cable end connector assembly as claimed in claim 12, wherein tail portions of the grounding contacts each is installed between the wire and the grasp member.

14. The cable end connector assembly as claimed in claim 12, wherein the contacts are inserted into corresponding slots of a dielectric holder having a retention portion forming a pair of protrusions thereof.

15. The cable end connector assembly as claimed in claim 1, wherein the first shielding portion has opposite side walls each defining an elastic tab extending inwardly and rearwardly thereof.

16. The cable end connector assembly as claimed in claim 1, wherein the first shielding portion includes two removable rectangular-shaped metal plates.

* * * * *